US005388388A

United States Patent [19]

Belec et al.

[11] Patent Number: 5,388,388

[45] Date of Patent: Feb. 14, 1995

[54] METHOD AND APPARATUS FOR DIVERTING AN ENVELOPE IN AN INSERTER

[75] Inventors: Eric A. Belec, Southbury; William J. Wright, Killingworth, both of Conn.

[73] Assignee: Pitney Bowes Inc., Stamford, Conn.

[21] Appl. No.: 74,528

[22] Filed: Jun. 11, 1993

[51] Int. Cl.[6] ..... B65B 5/06; B65B 57/04

[52] U.S. Cl. ..... 53/460; 53/53

[58] Field of Search ..... 53/67, 69, 53, 460, 53/569, 284.3, 381.5, 389.1

[56] References Cited

U.S. PATENT DOCUMENTS

| | | | |
|---|---|---|---|
| 4,674,258 | 6/1987 | Ehlscheid et al. | 53/569 X |
| 4,852,334 | 8/1989 | Auerbach | 53/569 |
| 5,042,232 | 8/1991 | Orsinger et al. | 53/460 |

FOREIGN PATENT DOCUMENTS

| | | | |
|---|---|---|---|
| 566895 | 12/1958 | Canada | 53/569 |

*Primary Examiner*—John Sipos

*Attorney, Agent, or Firm*—Charles R. Malandra, Jr.; Melvin J. Scolnick

[57] ABSTRACT

Apparatus and a method for inserting documents into an envelope. The apparatus includes: an envelope inserting station; a device for feeding documents toward an envelope situated at the envelope inserting station; a device for inserting the documents into the envelope; a device for sensing whether or not the envelope is properly aligned at the insert station to receive the documents; and a device for diverting an envelope not properly aligned at the insert station.

6 Claims, 5 Drawing Sheets

70
72

70
72

70
72

86
88
82
84

86
88
80

METHOD AND APPARATUS FOR DIVERTING AN ENVELOPE IN AN INSERTER

BACKGROUND OF THE INVENTION

The instant invention relates to apparatus and a method for handling high volume business mail, and in particular, to in-line, inserter devices having a plurality of hopper-held insert feeding assemblies positioned along conveyors for dispensing inserts onto the conveyors, and devices for stuffing envelopes with inserts.

Many present mechanical devices for stuffing inserts into envelopes employ conveyors for conveying stack-dispensed inserts to an envelope stuffing device. Multiple inserter devices rely on a plurality of hoppers which are disposed along conveyors and which dispense inserts onto the conveyor in predetermined manner to result in collated packages of inserts that are subsequently inserted into envelopes.

Increasingly widespread need in commercial and governmental institutions is found for envelope inserting equipment that is capable of operating at higher celerities with high reliabilities and short down-times. Problems associated with high-speed operation of such equipment are generally of a kind that do not exist or are inconsequential in lower speed operations. Such problems, for instance, relate to high accelerations and decelerations of mechanical components and inserts and envelopes, together with frictional, inertial, and other effects impacting the moving equipment components and document materials being manipulated. Moreover, demands on accuracy of document material positioning and alignment in the course of document handling is greatly increased in high speed operation.

Additionally, equipment down-time takes on a whole new meaning when high speed operation is involved. Even a short down-time represents loss of significant proportions of production runs and requires costly, skilled operator action in order to remedy the cause, as well as to re-set pre-programmed operation to obtain the required production.

Heretofore, whenever envelopes have been delivered to the inserting station to receive inserts, a mis-alignment of the envelope has resulted in either a jammed envelope or the entire inserting device being stopped, both of which result in significant down-time. Thus, the instant invention provides a method and apparatus which results in neither a jammed envelope or the inserting device being stopped.

SUMMARY OF THE INVENTION

Thus, the instant invention provides envelope inserting apparatus which comprises: an envelope inserting station; means for feeding documents toward an envelope situated at the envelope inserting station; means for inserting the documents into the envelope; means for sensing whether or not the envelope is properly aligned at the insert station to receive the documents; and means for diverting an envelope not properly aligned at the insert station.

The instant invention also provides a method of inserting documents into an envelope. The method comprises: feeding envelopes seriatim toward an inserting station; stopping the envelopes at the inserting station; feeding documents toward an envelope waiting at the inserting station; inserting the documents into the waiting envelope; sensing whether or not the envelope is properly aligned at the insert station to receive the documents; and diverting an envelope not properly aligned at the insert station.

DETAILED DESCRIPTION OF THE PREFERRED EMBODIMENT

Figure 1:
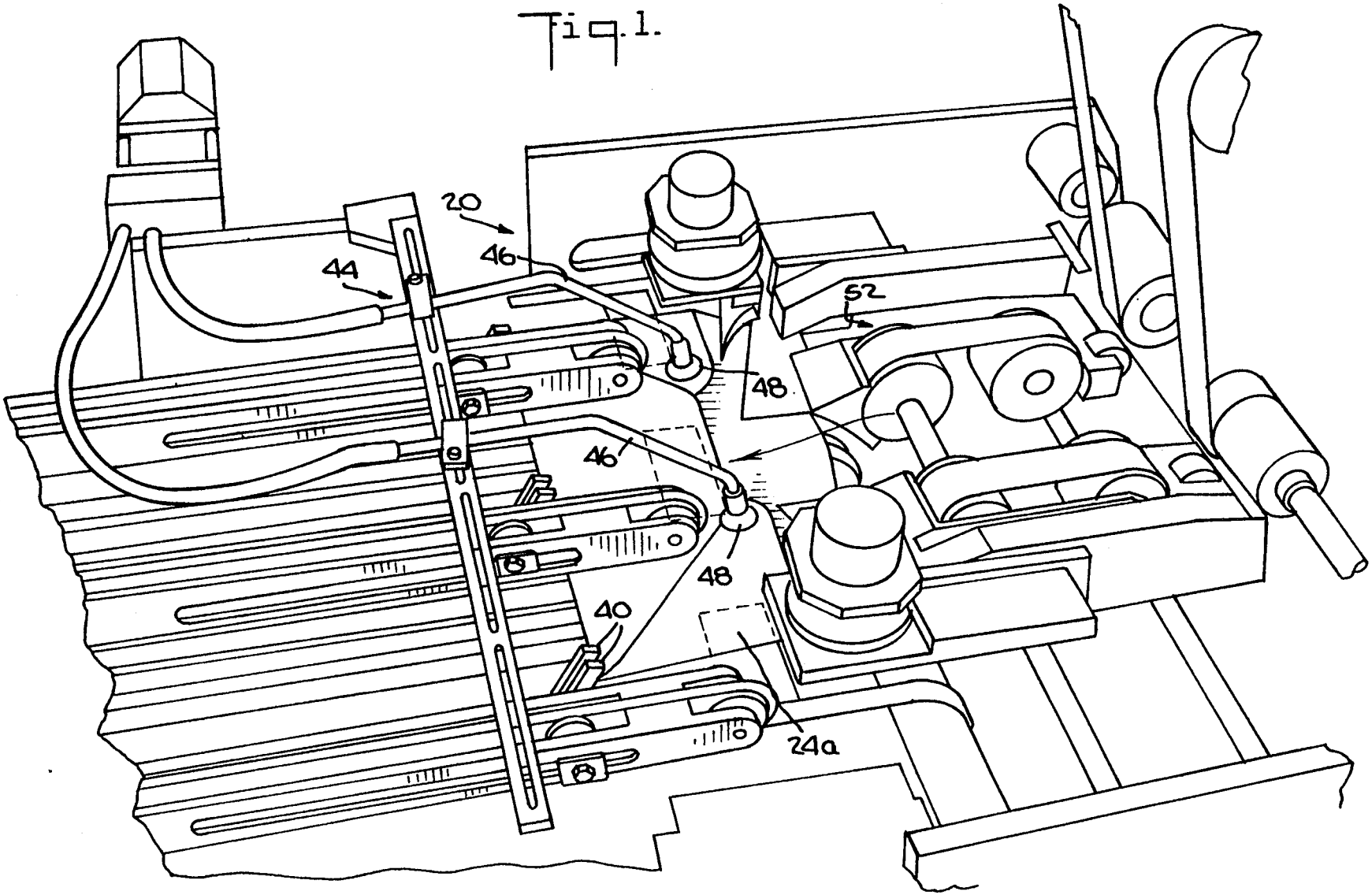
FIG. 1 is a perspective view of envelope inserting apparatus in accordance with the instant invention.
Figure 2:
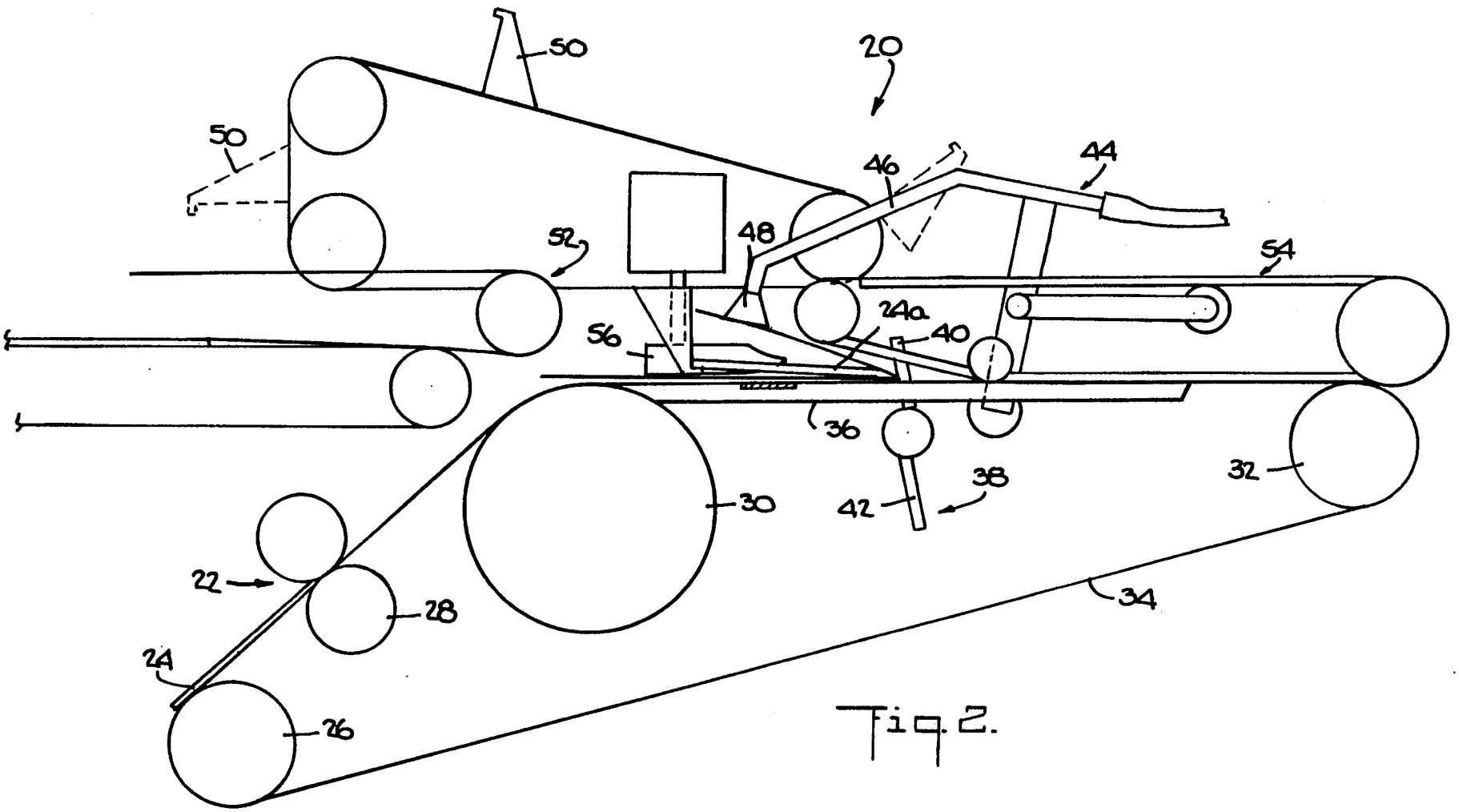
FIG. 2 is a schematic, side, elevational view of the apparatus seen in FIG. 1.

In describing the preferred embodiment of the instant invention, reference is made to the drawings, wherein there is seen in FIGS. 1 and 2 envelope inserting apparatus generally designated 20 which includes an envelope staging area 22 which consists of a series of laterally spaced roller nips that accept/provide envelopes 24 from a known location. The staging area 22 is driven by a smart motor (not shown) via timing pulleys and a belt (not shown). The smart motor could be replaced by a clutch-brake arrangement.

The envelope inserting apparatus 20 further includes a vacuum drum 30 which supplies valved, vacuum force to its periphery and contains pulleys (not shown) that allow the transport belts 34 to move about its circumference.

The envelope inserting apparatus 20 further includes a vacuum deck 36 having a surface containing a series of vacuum plenums. Each plenum provides a vacuum source to the top of the deck 36 through a series of holes which are straddled by the transport belts 34, which are guided along the top of the deck 36 in specific grooves (not shown). Between each pair of belts 34 is a groove which allows a backstop 38 to protrude above the top of the vacuum deck 36.

The backstop 38 consists of a series of parallel, spaced "two-around" fingers 40 and 42 that protrude above the vacuum deck 36 and create a wall against which an incoming envelope 24 will stop.

Another component of the envelope inserting apparatus 20 is the sucker bar assembly 44 which spans the width of the vacuum deck 36 and has tubes 46 at the end of which are suction cups 48. As the cups 48 are pivoted toward the deck 36, the vacuum is valved on to acquire the throat of an envelope 24, and as the cups 48 are rocked backward the corresponding envelope 24 is opened.

The inserting apparatus 20 also includes an overhead pusher 50 which pushes the document collation (not shown) into a waiting envelope 24*a*. A dual belt transport 52 accepts the collation and begins to urge the collation toward the waiting envelope 24*a* for a certain distance, after which the overhead pusher 50 gains control of the collation.

Figure 3:
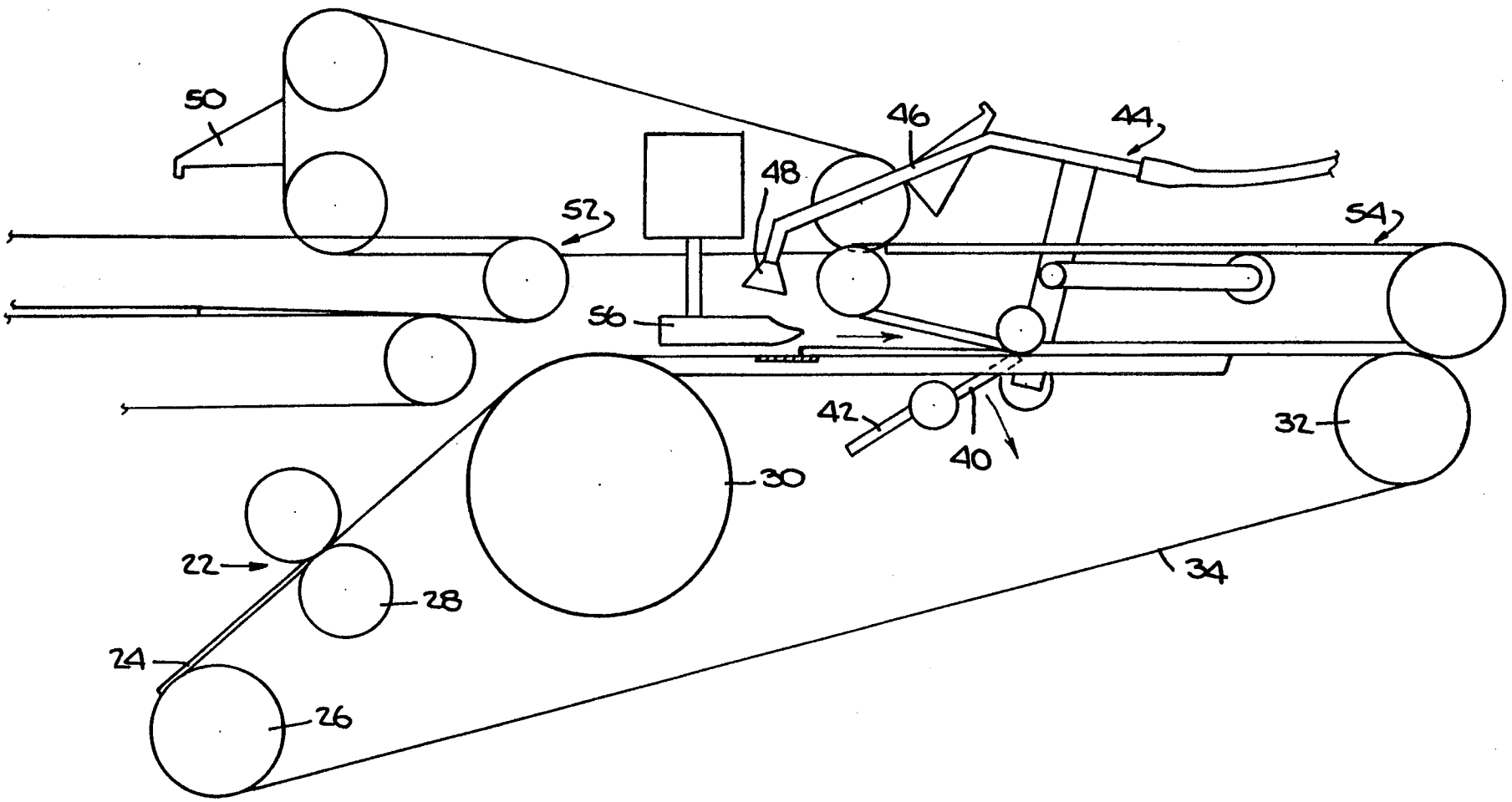
FIG. 3 is similar to FIG. 2 but shows the envelope backstop dropped below the envelope path to allow an envelope to be conveyed downstream for further processing.
Figure 4:
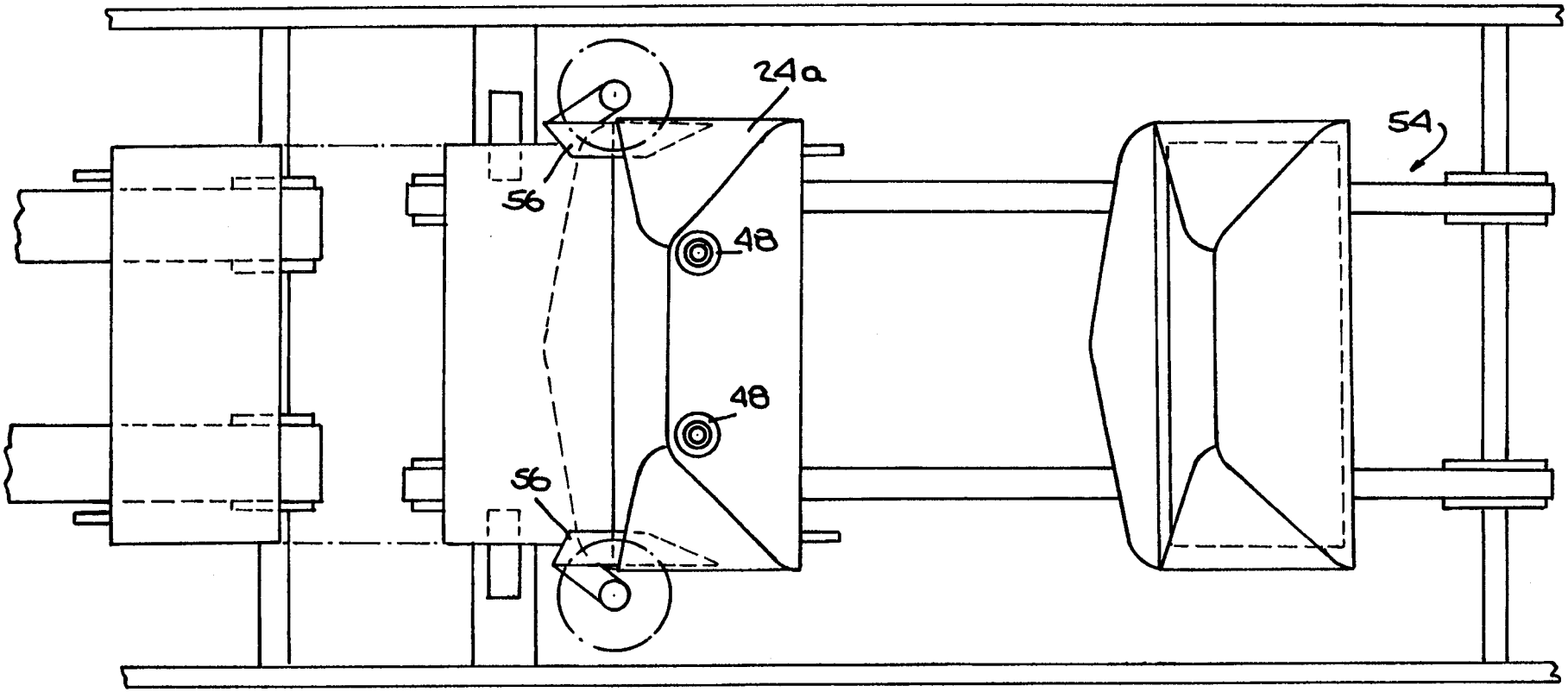
FIG. 4 is a top, plan view of the apparatus seen in FIG. 1.

The inserting apparatus 20 further includes an output belt/nip system 54 to positively control the output transport for filled envelopes 24 as they exit past the backstop 38 (see FIG. 3).

To facilitate entry of the collation into the waiting envelope 24*a*, a pair of funnel shapes guides 56 are pivoted into the waiting envelope 24*a* to shape/support the edges of the envelope 24*a*.

Figures 5, 6, 7, 8, 9:
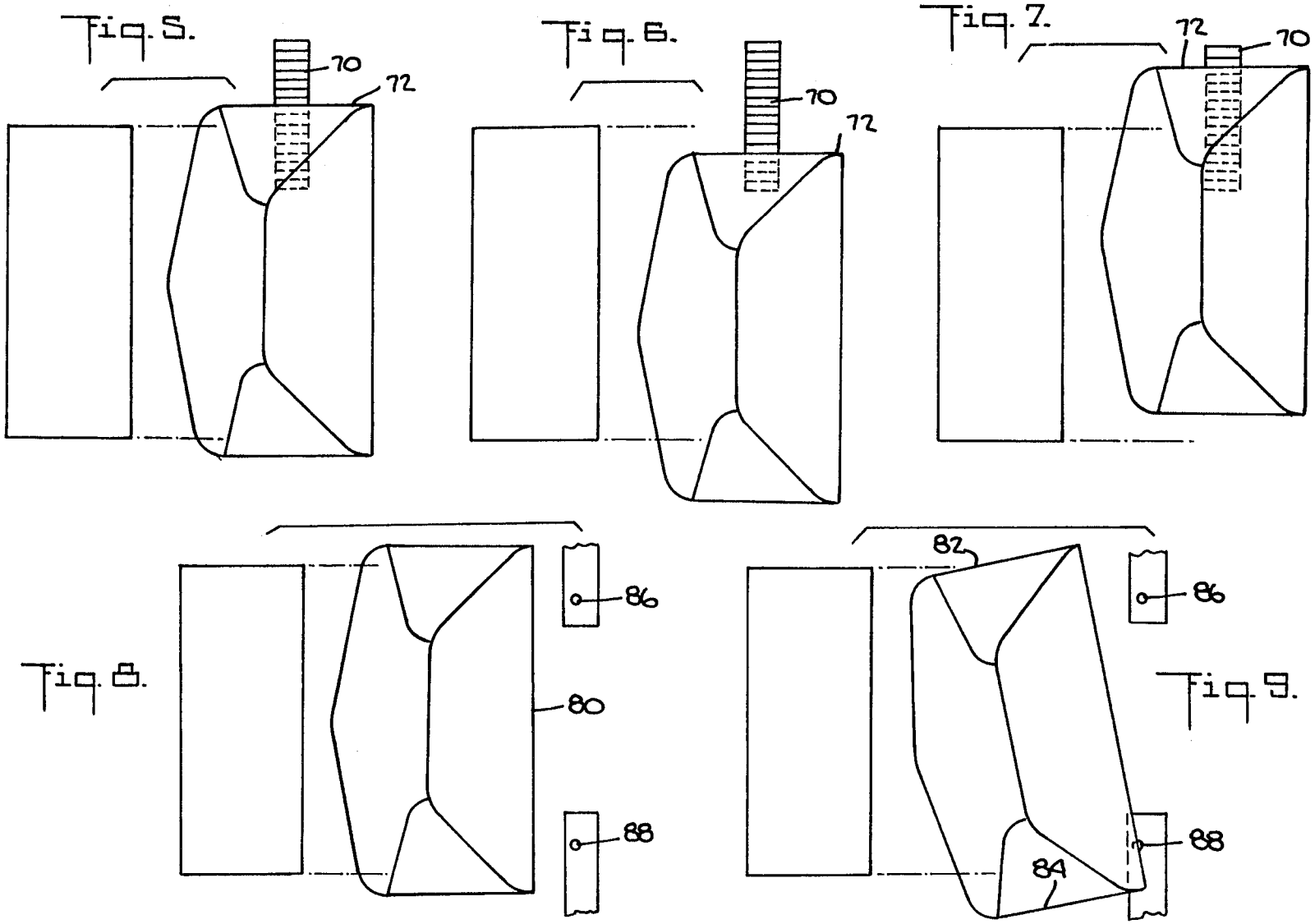
FIG. 5 is a top, plan view showing an envelope properly aligned from side to side on the side sensors for receiving inserts.
FIG. 6 is similar to FIG. 5 but shows the envelope positioned improperly toward one side so that the insert cannot be pushed into the envelope.
FIG. 7 is similar to FIG. 6 but shows the envelope improperly positioned toward the other side so that the insert cannot be pushed into the envelope.
FIG. 8 is similar to FIG. 5 but shows the envelope properly aligned with respect to its direction of travel on the direction sensors.
FIG. 9 is similar to FIG. 8 but shows the envelope skewed on the direction sensors.

In order to insert collations into a waiting envelope 24*a*, the envelope 24*a* must be properly aligned, which means that the envelope 24*a* must be properly located, side to side, and not skewed. FIGS. 5–7 relate to side to side location, and FIG. 8 and 9 relate to skew. A sensor array 70 seen in FIGS. 5–7 is located upstream of the backstop 38. Reflective sensors work well, and other types can be used, such as thru-beam or retro-reflective. The sensor array 70 is located across the desired region of an envelop edge 72. In the desired/nominal envelope position, seen in FIG. 5, a certain number or percentage of sensors will be covered by the envelope 24*a*. When fewer sensors are covered than the nominal quantity, the envelope 24*a* is displaced away (remote) from the desired position, as seen in FIG. 6. When more sensors are covered than the nominal quantity, the envelope is misaligned beyond the desired position, as seen in FIG. 7.

The measurement of skew across the width 80 of the envelope 24*a* traveling at constant velocity may be measured by knowing the amount of time that elapses between the two sides 82 and 84 of a lead edge of the envelope 24*a* crossing two sensors 86 and 88 located upstream of the backstop 38 and aligned with the direction of travel (see FIGS. 8 and 9). If there is little skew, as in FIG. 8, the time differential will be minimal. However, with extreme skew, as in FIG. 9, the time differential will be large.

If the envelope 24*a* is properly aligned, i.e. side to side location and skew are proper, the envelope 24*a* will be stopped by the backstop 38, as seen in FIG. 2, and filled with the collation. If the envelope 24*a* is not properly aligned, as signaled by the sensor array 70 and the skew sensors 86 and 88, the backstop 38 is not raised but is maintained in the lowered position seen in FIG. 3. The unfilled envelope 24*a* is carried beyond the backstop 38 and is diverted downstream out of the path of travel of filled envelopes 24*a*.

From the foregoing description, it can be seen that although an envelope may be improperly aligned, due to either skew or side location, the staging area 22 and the entire inserting apparatus 20 is not shut down, and a jam is not allowed to occur, owing to the ability of inserting apparatus 22 to permit a misaligned envelope to simply pass through. These advantages are derived from an event-driven inserting apparatus 22 and the sensors used therein. A Synchronous inserting apparatus is incapable of such a diverting of misaligned envelopes.

It should be understood by those skilled in the art that various modifications may be made in the present invention without departing from the spirit and scope thereof, as described in the specification and defined in the appended claims.

What is claimed is:

1. An envelope inserting apparatus, comprising:

an envelope inserting station;

means for feeding documents toward an envelope situated at said envelope inserting station;

means for stopping said envelope at said insertion station and for inserting said documents into said envelope;

means for sensing whether or not said envelope is properly aligned without skew at said inserting station to receive said documents; and means for disabling said stopping means for an envelope not properly aligned at said inserting station to allow further movement of said misaligned and empty envelope.

2. The apparatus of claim 1, wherein said sensing means includes first sensors for sensing side to side location of said envelope and second sensors to sense skew of the envelope.

3. The apparatus of claim 1, additionally comprising a backstop having a raised position for stopping said envelope at said inserting station and a lowered position for allowing envelopes to pass by or exit said inserting station.

4. The apparatus of claim 3, wherein said disabling means comprises the backstop being in a lowered position to allow envelopes not properly aligned to pass by the inserting station.

5. A method of inserting documents into an envelope, comprising:

feeding envelopes seriatim toward an inserting station;

sensing whether or not said envelopes are properly aligned without skew at said inserting station to receive said documents;

stopping the properly aligned envelopes at said insertion station and not stopping an envelope not properly aligned without skew at said inserting station;, feeding documents toward an envelope properly aligned without skew waiting at said inserting station; and inserting said documents into said waiting envelope.

6. The method of claim 5, wherein said sensing includes sensing side to side location of said envelope and sensing skew of the envelope.

* * * * *